United States Patent [19]

Doerffer

[11] 4,237,808

[45] Dec. 9, 1980

[54] STERN BRAKING DEVICE

[75] Inventor: Jerzy Doerffer, Polska, Poland

[73] Assignee: Politechnika Gdanska, Gdansk, Poland

[21] Appl. No.: 37,565

[22] Filed: May 9, 1979

[30] Foreign Application Priority Data

May 10, 1978 [PL] Poland ..... 206680

[51] Int. Cl.[3] ..... B63H 25/34

[52] U.S. Cl. ..... 114/170; 114/145 R

[58] Field of Search ..... 114/145 R, 145 A, 170

[56] References Cited

U.S. PATENT DOCUMENTS

| | | | |
|---|---|---|---|
| 655,140 | 7/1900 | Wendler | 114/145 R |
| 2,751,875 | 6/1956 | Henry | 114/145 A |
| 2,998,795 | 9/1961 | Downie et al. | 114/145 A |
| 3,046,928 | 7/1962 | Sherrill | 114/145 R X |
| 4,026,231 | 5/1977 | Fedorko | 114/145 A |

FOREIGN PATENT DOCUMENTS

| | | | |
|---|---|---|---|
| 154126 | 11/1920 | United Kingdom | 114/145 R |

*Primary Examiner*—George E. A. Halvosa
*Attorney, Agent, or Firm*—Ladas & Parry

[57] ABSTRACT

This invention relates to stern braking device in a form of a shield, which is characterised by placing the shield behind the propeller and the rudder, which at top part has a concave cross section on both sides of plane of symmetry and a hydraulic stabilizer and is hingewise connected at the top, to a lifting gear capable of sliding up and down, whereas the bottom of the shield is connected hingewise to the ship's hull.

2 Claims, 9 Drawing Figures

STERN BRAKING DEVICE

The present invention relates to the stern braking device for ships with no navigation limits, especially for large ships.

Stern braking devices known till now are working on the principle of redirecting the propeller race forward by means of a shield or a system of inverted shields. Best known is Parson's bowl, that is lowered on long struts directly in behind the propeller shown in the publication "Sir Charles Parson's and The Naval Architect", Page 14.

French Pat. No. 1. 129,846 represents a stern shield, which is lowered between the propeller and the rudder. This device is also known from the above publication. Both these devices have similar deficiency in that they require an extensive reconstruction of the stern increasing the ship resistance under normal service conditions. Placing the shield in front of the rudder unables the steering of the ship that could not be steering during the braking process. Both devices could not be used for auxiliary steering the ship.

Clausen's rudder and Bröhl's double rudders are well known from a monthly Schiff und Hafen, Heft 4/1974/24 Jahrgang/. Clausen's rudder has vertical and adjustable guides of four flaps, which could be turned round their vertical axis. Bröhl's double rudder consists of blades formed out of vertically adjustable flaps, which after turning by an angle of 90° generate an inverted double shield, similar to Clausen's arrangement.

The disadvantage of the above arrangements is that Parson's bowl serves for braking only, while Clausen's and Bröhl's rudders serve for braking and steering, but to a very limited extent for steering in braking process. The above enumerated devices are of little use for large seagoing vessels because of small distance from the propeller and in case of rudders because of complicated multidirectional kinematic layout, which is exposed in the region of eddy flow to rapidly changing loads being not able to mitigate these hydraulic disturbances and thus to lower the vibrations and sudden jerks.

The aim of the invention is to improve the maneouvering abilities of the ship and to simplify its main power installation by eliminating the reversing gear. It gives the possibility of auxiliary steering the ship.

Stern braking device in the form of a shield according to the present invention is distinguished by placing it behind the propeller and rudder. It has a concave profile with a hydraulic jet stabilizer and it is fastened at the top hingewise to a lifting gear capable of sliding up and down, whereas the bottom of the shield is fastened hingewise to the hull. The after side of the shield is flat and with an undercut forward at the lower part the bottom of the shield has the contour almost identical with the cross section of the hull at the stowed position of the shield. The hydraulic jet stabilizer is placed in the center of the shield and in lowered position this center coincides with the axis of the propeller.

Alternative arrangement of stern braking device in the form of a shield according to the invention comprises a concave shield situated behind the propeller and the rudder, fitted with the hydraulic jet stabilizer. The shield at the top is connected hingewise to a lifting gear capable of sliding up and down and the bottom of the shield is fastened hingewise to the hull. Flaps are fitted on both sides of the shield, that could change the angle preferably by means of hydraulic hinges.

The shield has its forward surface concave with regard to the axis of symmetry and the after surface is flat with an undercut forward at the lower part, while the contour of the bottom part corresponds with the contour of the hull at the stowed position of the shield. The hydraulic jet stabilizer is placed in the center of the shield and in lowered position this center coincides with the axis of the propeller. Bottom part of the shield is connected with the hull by means of hinges and struts.

Side flaps could change independently the angle from 0° to 90° to the sides, and at maximum angle of inclination they are resting on stoppers.

Research work carried out with the proposed device and previous pilot tests indicate the great importance of the shape of forward surface of the shield and the relation between the size of the device and propeller diameter and their influence upon the force induced by a turning propeller upon the shield.

The results of the tests carried out with a given shape of braking device and corresponding dimensional ratio of device and propeller clearly indicate that this device will successfully compete with variable pitch propeller, which up till now is the best device for braking the ships.

Additional feature that is increasing the benefits as compared with the variable pitch propeller is the possibility of almost instantaneous securing the full effectiveness of braking without the necessity of maneouvering the main engine with the exception of small reduction of revolutions in order to avoid overloading caused by the increase of propeller moment.

The possibility of regulating the size and the direction of the force induced by the propeller on the stern braking device with the help of side flaps from the highest values exceeding the propeller thrust to the forces equal and lower than propeller thrust enables full control of the braking process without the wide range of maneouvers with the main engine and especially without reversing the main engine, what is of great importance with certain types of drives.

The advantages resulting from the application of the device according to the present invention consists in its mechanical simplicity, in the possibility of removing any deficiencies in case of damage without the need of docking the ship, in the possibility of fitting it on any ship in service or under construction without any major modifications and in the possibility of using it as a steering device independently of the main rudder both in braking the ship as well as in slow steaming, what in many situations may be of very great importance.

Further, the device facilitates the control of speed and of direction of thrust especially at low speeds through the appropriate vertical positioning the shield at constant forward speed of the propeller. At zero speed of the ship and appropriate positioning the shield, there exists the possibility of obtaining a high side thrust, thus replacing the side thruster.

The struts connecting lower part of the shield with the hull while the shield is in top position are placed in longitudinal slots in the shell, thus they are not increasing the resistance of the ship in service as they are not working as appendages.

Embodiments of the present invention will now be described by way of example with reference to the accompanying drawings in which.

Figure 1:
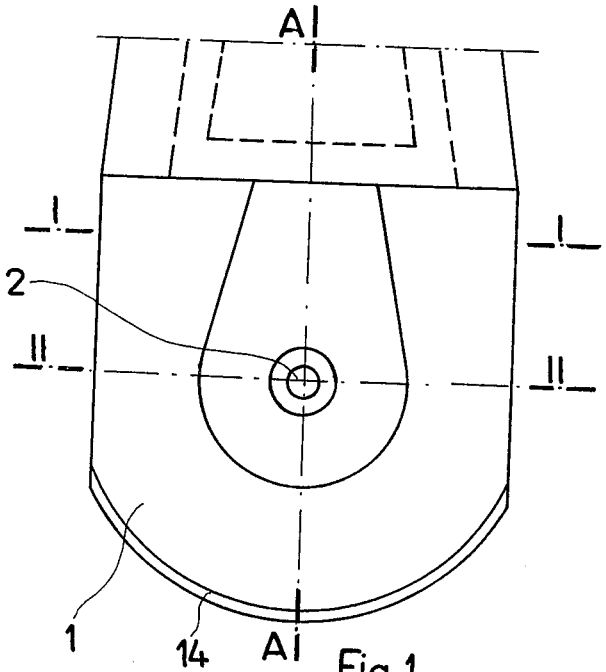
FIG. 1 shows the front view of the stern device.
Figure 2:
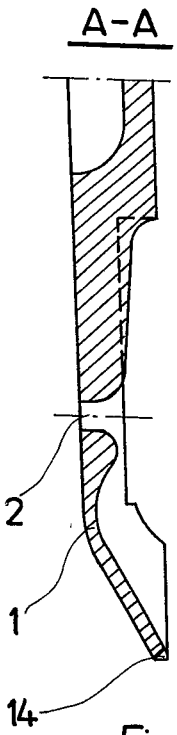
FIG. 2 shows the section of the stern device in the plane of symmetry denoted by A—A in FIG. 1.
Figure 3:
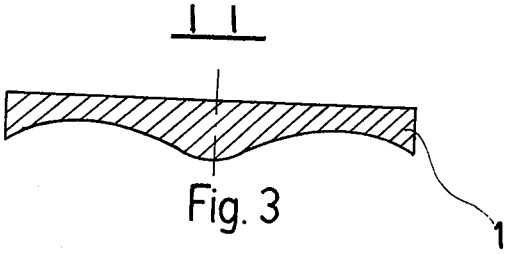
FIG. 3 shows the section of the stern device in the plane I—I in FIG. 1.
Figure 4:
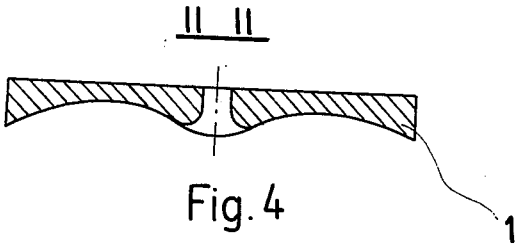
FIG. 4 shows the section of the stern device in the plane II—II in FIG. 1.
Figure 5:
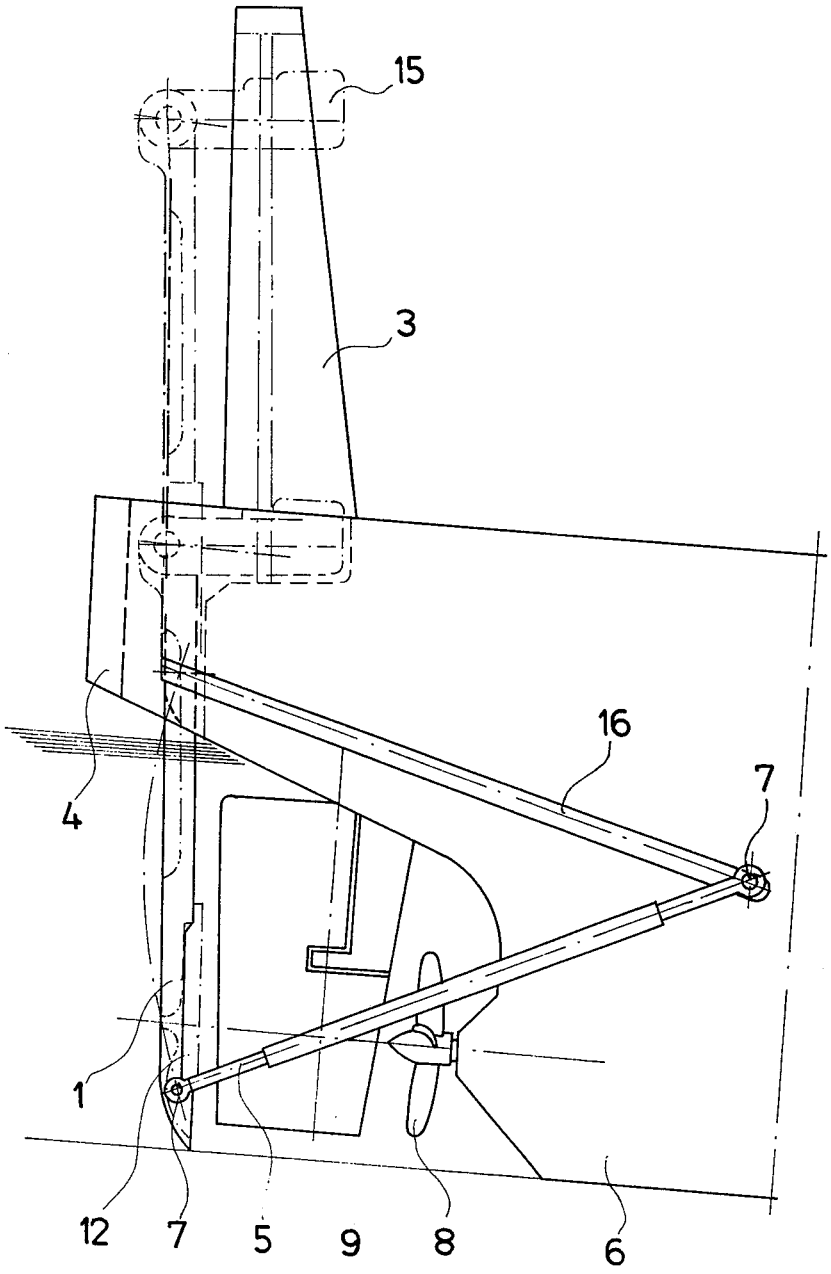
FIG. 5 shows a side view of the stern device in lowered position and additionally with dotted line—the stern device is shown in raised position.

FIGS. 1, 2, 3, 4 and 5 shows the device formed by a shield 1 with a concave profile in at least both vertical and horizontal cross-sections and having a hydraulic jet stabilizer 2 formed by a circular opening having in cross-section a fluid-accelerating profile. Sliding guide 3 is situated at the stern of the ship 4.

The bottom of the shield 1 is fastened to the hull 6 by two struts 5, one on each longitudinal side of the hull, having a common pivot axis about hinges 7. Hydraulic jet stabilizer 2 is situated in the center of the shield and in lowered position its axis is coinciding with the axis of the propeller 8.

The device is placed behind the propeller 8 and behind the rudder 9.

Figure 6:
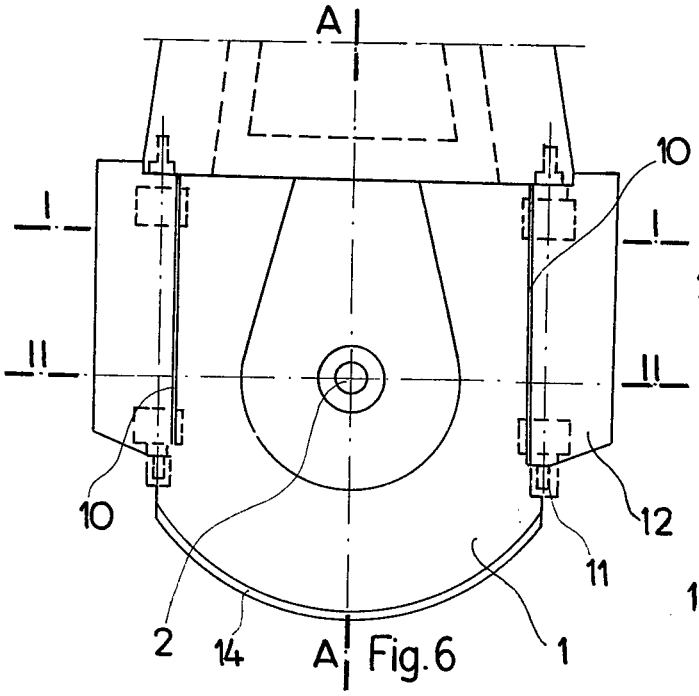
FIG. 6 shows the front view with vertical side flaps.
Figure 7:
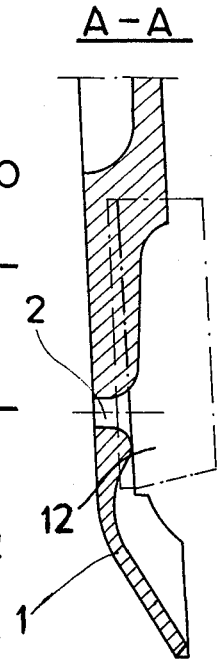
FIG. 7 shows the section of stern device with vertical side flaps in the plane A—A in FIG. 6.
Figure 8:
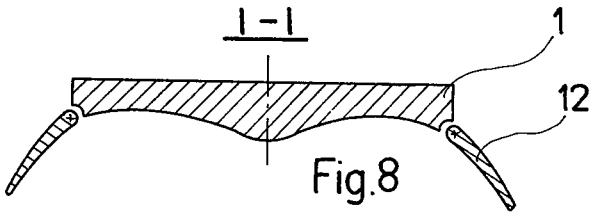
FIG. 8 shows the section of stern device with vertical side flaps in the plane I—I in FIG. 6.
Figure 9:
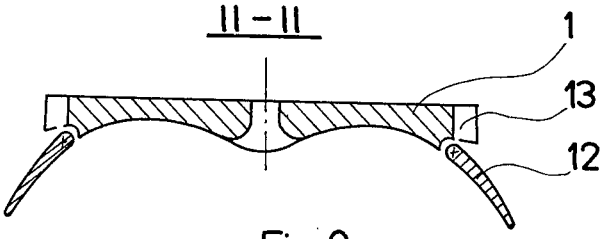
FIG. 9 shows the section of stern device with vertical side flaps in plane II—II in FIG. 6.

The alternative arrangement shown in FIGS. 6, 7, 8, and 9 has on vertical edges 10 of the shield 1 side flaps 12 that could change the angle preferably by means of hydraulic hinges 11. Side flaps 12 could change the angle from 0° to 90° independently of each other and at the maximum angle they will rest upon a limit bearers 13, fitted on the shield 1.

In both arrangements shield 1 has the forward top part of concave profile symmetrically to the plane of symmetry and the after part is flat with an under cut forward at the lower part, while the contour of the bottom part 14 of the shield 1 coincides with the cross section of the stern 4 at the stowed position of the shield 1.

The device could be used in following situations:

"crash stopping" with full course control;

side thrusting of the stern without forward movement of the ship;

very slow manoeuvering the ship.

In the situation of "crash stopping" the ship, the shield 1 must be disengaged in blockade of sliding guide 3 and lowered to the bottom position limited by the lowest position of lifting device 15 in the guide 3. At the same time the revolutions of the propeller 8 should be slighly lowered in order not to let the main engine be overloaded.

Course control during braking process could be excersised by means of the main rudder 9, by means of vertical side flaps 12 or jointly by these two devices. At the end of the manouevre the angle of inclination of side flaps 12 is liquidated, the shield 1 is lifted up to the top position and blocked in sliding guide 3.

The top part of the shield 1 is hingewise connected to the lifting gear 15, capable of sliding up and down in a guide 3 situated at the stern and giving no possibility of transverse movement.

In stowed position of the shield the struts 5 are housed in longitudinal recesses 16 under the stern overhang.

In the situation of side thrusting the stern 4 the shield 1 is lowered before starting the propeller 8 to turn and the rudder 9 is turned as well as the vertical side flaps 12 in order to get from the propeller race side thrust only. The propeller revolutions are slowly raised watching the behaviour of the stern 4 and giving the correction to angle of turn of rudder and flaps.

In the situation of very slow manoeuvering the ship the shield 1 is lowered to an intermediate position partially covering the propeller race only and the speed and the direction of ship movement is controlled by changing the vertical position of the shield 1 and angle of inclination of the rudder 9 and vertical side flaps 12.

What we claim is:

1. A stern braking device for a vessel, comprising shield means having a generally concave profile and pivotably mounted behind the propeller and the rudder of the vessel, said shield means including aperture means extending through the center of said shield means for stabilizing hydraulic fluid flow therethrough directly behind said rudder and being coaxially positioned with respect to said propeller, said aperture means having in cross-section a fluid-accelerating profile, said shield means being vertically movable from a first position within the vessel directly above said rudder, and a second position directly behind said rudder, adjustable linkage means supporting said shield means in said second position including means having a common pivot axis defined by corresponding hinge means at opposite sides of the hull of said vessel, said linkage means being coupled to support said shield means at points above and below said aperture means, and said shield means being concave both in vertical cross-section and in horizontal cross-section for deflection and redistribution of hydraulic fluid flow thereagainst.

2. A device according to claim 1 including a vertically arranged pair of flap means mounted to one on each side of said shield means and coupled to hydraulic control means for adjustable independent positioning thereof, and limiting means mounted on said shield means along said vertical sides directly behind said flap means to limit rearward deflection thereof.

* * * * *